US008647111B2

(12) United States Patent
Mennie et al.

(10) Patent No.: US 8,647,111 B2
(45) Date of Patent: Feb. 11, 2014

(54) GAS COMBUSTION APPARATUS

(75) Inventors: Darren Mennie, Bristol (GB); Nicholas Benjamin Jones, North Somerset (GB)

(73) Assignee: Edwards Limited, West Sussex (GB)

( * ) Notice: Subject to any disclaimer, the term of this patent is extended or adjusted under 35 U.S.C. 154(b) by 1286 days.

(21) Appl. No.: 11/919,953

(22) PCT Filed: Apr. 28, 2006

(86) PCT No.: PCT/GB2006/001577
§ 371 (c)(1),
(2), (4) Date: Nov. 5, 2007

(87) PCT Pub. No.: WO2006/117531
PCT Pub. Date: Nov. 9, 2006

(65) Prior Publication Data

US 2009/0064909 A1 Mar. 12, 2009

(30) Foreign Application Priority Data

May 5, 2005 (GB) ..... 0509163.2

(51) Int. Cl.
*F23C 99/00* (2006.01)

(52) U.S. Cl.
USPC ..... 431/2; 431/5; 431/187; 110/214; 110/212; 422/173

(58) Field of Classification Search
USPC ..... 431/2, 5, 187; 110/214, 212; 422/173, 422/172, 182
See application file for complete search history.

(56) References Cited

U.S. PATENT DOCUMENTS

| | | | | |
|---|---|---|---|---|
| 3,508,868 | A * | 4/1970 | Raisaku | 423/545 |
| 4,113,838 | A * | 9/1978 | Koike et al. | 423/235 |
| 4,555,389 | A | 11/1985 | Soneta et al. | |
| 4,988,287 | A * | 1/1991 | Stegelman et al. | 431/284 |
| 5,957,678 | A * | 9/1999 | Endoh et al. | 431/5 |
| 7,254,939 | B2 * | 8/2007 | Duvinage et al. | 60/286 |
| 2003/0108831 | A1 * | 6/2003 | Harada et al. | 431/2 |
| 2004/0126724 | A1 * | 7/2004 | Yamaguchi et al. | 431/2 |
| 2006/0104879 | A1 | 5/2006 | Chiu et al. | |

FOREIGN PATENT DOCUMENTS

| | | |
|---|---|---|
| EP | 0 262 561 A2 | 4/1988 |
| EP | 0 311 317 A2 | 4/1989 |
| EP | 0768109 A2 | 4/1997 |
| EP | 0 819 887 A2 | 1/1998 |

(Continued)

OTHER PUBLICATIONS

United Kingdom Search Report of Application No. GB 0509163.2; Date of mailing: Aug. 19, 2005; Claims searched: 1-26; Date of search: Aug. 18, 2005.

(Continued)

*Primary Examiner* — Avinash Savani
(74) *Attorney, Agent, or Firm* — Westman, Champlin & Koehler, P.A.

(57) ABSTRACT

A method of combusting ammonia is described, in which an exhaust gas containing varying amounts of at least ammonia and hydrogen is conveyed from a chamber to a combustion nozzle (34) connected to a combustion chamber (36). A combustion gas for forming a combustion flame within the chamber is supplied to the chamber. Depending on the relative amounts of ammonia and hydrogen exhaust from the chamber, hydrogen is added to the exhaust gas so that, when the exhaust gas contains ammonia, the gas combusted by the flame contains at least a predetermined amount of hydrogen.

23 Claims, 4 Drawing Sheets

(56) References Cited

FOREIGN PATENT DOCUMENTS

| | | | |
|---|---|---|---|
| EP | 1205707 | A2 | 5/2002 |
| JP | 6387519 | A | 4/1988 |
| JP | 63279014 | A | 11/1988 |
| JP | 02077433 | | 6/1990 |
| JP | 109551 | A | 1/1998 |
| JP | 10141648 | A | 5/1998 |
| JP | 2004112049 | | 1/2004 |
| WO | 2006083356 | A2 | 8/2006 |

OTHER PUBLICATIONS

PCT Notification of Transmittal of the International Search Report and the Written Opinion of the International Searching Authority, or the Declaration of International Application No. PCT/GB2006/001577; Date of mailing: Aug. 9, 2006.

PCT International Search Report of International Application No. PCT/GB2006/001577; Date of mailing of the International Search Report: Aug. 9, 2006.

PCT Written Opinion of the International Searching Authority of International Application No. PCT/GB2006/001577; Date of mailing: Aug. 9, 2006.

Prosecution history of corresponding European Patent Application No. 06726957.1 including: Communication dated Feb. 16, 2010; Response dated Mar. 10, 2010; Communication dated Apr. 14, 2010; Response dated Oct. 22, 2010.

Prosecution history of corresponding Japanese Patent Application No. 2008-509495 including: Notification of Reason for Rejection dated Apr. 5, 2010; Response dated Sep. 30, 2010; Notification of Reason for Rejection dated Nov. 1, 2010; Response dated Feb. 1, 2011.

Prosecution history of corresponding Korean Patent Application No. 2007-7025396 including: Final Rejection dated Dec. 2010; Office Action dated Apr. 20, 2010; Response dated Oct. 1, 2010; Response datedJan. 17, 2011.

Prosecution history of corresponding Taiwanese Patent Application No. 095116075 including: Office Action dated May 23, 2012; Search Report dated Apr. 20, 2012; Response dated Aug. 17, 2012.

* cited by examiner

GAS COMBUSTION APPARATUS

FIELD OF THE INVENTION

The present invention relates to apparatus for, and a method of, combusting an exhaust gas containing at least ammonia.

BACKGROUND OF THE INVENTION

A primary step in the fabrication of semiconductor devices is the formation of a thin film on a semiconductor substrate by chemical reaction of vapour precursors. One known technique for depositing a thin film on a substrate is chemical vapour deposition (CVD). In this technique, process gases are supplied to a process chamber housing the substrate and react to form a thin film over the surface of the substrate.

An example of a material commonly deposited on to a substrate is gallium nitride (GaN). GaN, and related material alloys (such as InGaN, AlGaN and InGaAlN) are compound semiconductors used for the manufacture of green, blue and white light emitting devices (such as LEDs and laser diodes) and power devices (such as HBTs and HEMTS). These compound semiconductors are usually formed using a form of CVD usually known as MOCVD (metal organic chemical vapour deposition). In overview, this process involves reacting together volatile organometallic sources of the group III metals Ga, In and/or Al, such as trimethyl gallium (TMG), trimethyl indium (TMI) and trimethyl aluminium (TMA), with ammonia at elevated temperatures to form thin films of material on wafers of a suitable substrate material (such as Si, SiC, sapphire or AlN). Hydrogen gas is generally also present, providing a carrier gas for the organometallic precursor and the other process gases.

Following the deposition process conducted within the process chamber, there is typically a residual amount of the gases supplied to the process chamber contained in the gas exhaust from the process chamber. Process gases such as ammonia and hydrogen are highly dangerous if exhausted to the atmosphere, and so in view of this, before the exhaust gas is vented to the atmosphere, abatement apparatus is often provided to treat the exhaust gas to convert the more hazardous components of the exhaust gas into species that can be readily removed from the exhaust gas, for example by conventional scrubbing, and/or can be safely exhausted to the atmosphere.

One known type of abatement apparatus is described in EP-A-0 819 887. This abatement apparatus comprises a combustion chamber having an exhaust gas combustion nozzle for receiving the exhaust gas to be treated. An annular combustion nozzle is provided outside the exhaust gas nozzle, and a gas mixture of a fuel and air is supplied to the annular combustion nozzle for forming a flame inside the combustion chamber for burning the exhaust gas received from the process chamber to destroy the harmful components of the exhaust gas.

This form of abatement apparatus is generally located downstream from a pumping system for drawing the exhaust gas from the process chamber. To prevent damage to the pumping system as the exhaust gas passes therethrough, a nitrogen purge gas is typically supplied to one or more purge ports of the pumping system for pumping with the exhaust gas. As a result, the gas received by the abatement apparatus usually also contains a significant amount of nitrogen.

Nitrogen is safe and requires no abatement. With the apparatus such as that described in EP-A-0 819 887, we have found that the destruction and removal efficiency (DRE) of hydrogen is very high, often exceeding 99.99%, whilst the DRE of ammonia is highly variable depending on the other gases contained within the exhaust gas entering the abatement apparatus. Ammonia is highly toxic, having a threshold limit value, or TLV, of 25 ppm, and we have found that the amount of ammonia exhaust from the abatement apparatus can be as high as 2400 ppm depending on the chemistry and the relative amounts of the gases contained within the exhaust gas.

It is an aim of at least the preferred embodiment of the present invention to seek to provide a method of, and apparatus for, combusting ammonia with a consistently high DRE irrespective of the other gases, and the relative amounts thereof, present in an exhaust gas containing the ammonia.

SUMMARY OF THE INVENTION

In a first aspect, the present invention provides a method of combusting ammonia, the method comprising the steps of conveying an exhaust gas containing varying amounts of at least ammonia and hydrogen from a chamber to a combustion nozzle connected to a combustion chamber, supplying to the chamber a combustion gas for forming a combustion flame within the chamber, and selectively adding hydrogen to the exhaust gas depending on the relative amounts of ammonia and hydrogen exhaust from the chamber so that, when the exhaust gas contains ammonia, the gas combusted by the flame contains at least a predetermined amount of hydrogen.

In a second aspect, the present invention provides apparatus for combusting exhaust gas, the apparatus comprising a combustion chamber, means for supplying to the chamber a combustion gas for forming a combustion flame within the chamber, a combustion nozzle connected to the combustion chamber, means for conveying an exhaust gas containing varying amounts of at least ammonia and hydrogen from a chamber to the nozzle, and means for selectively adding hydrogen to the exhaust gas depending on the relative amounts of ammonia and hydrogen exhaust from the chamber.

Features described above in relation to method aspects of the invention are equally applicable to apparatus aspects of the invention, and vice versa.

BRIEF DESCRIPTION OF THE DRAWINGS

Preferred features of the present invention will now be described with reference to the accompanying drawing, in which.

DETAILED DESCRIPTION OF THE INVENTION

Figure 1:
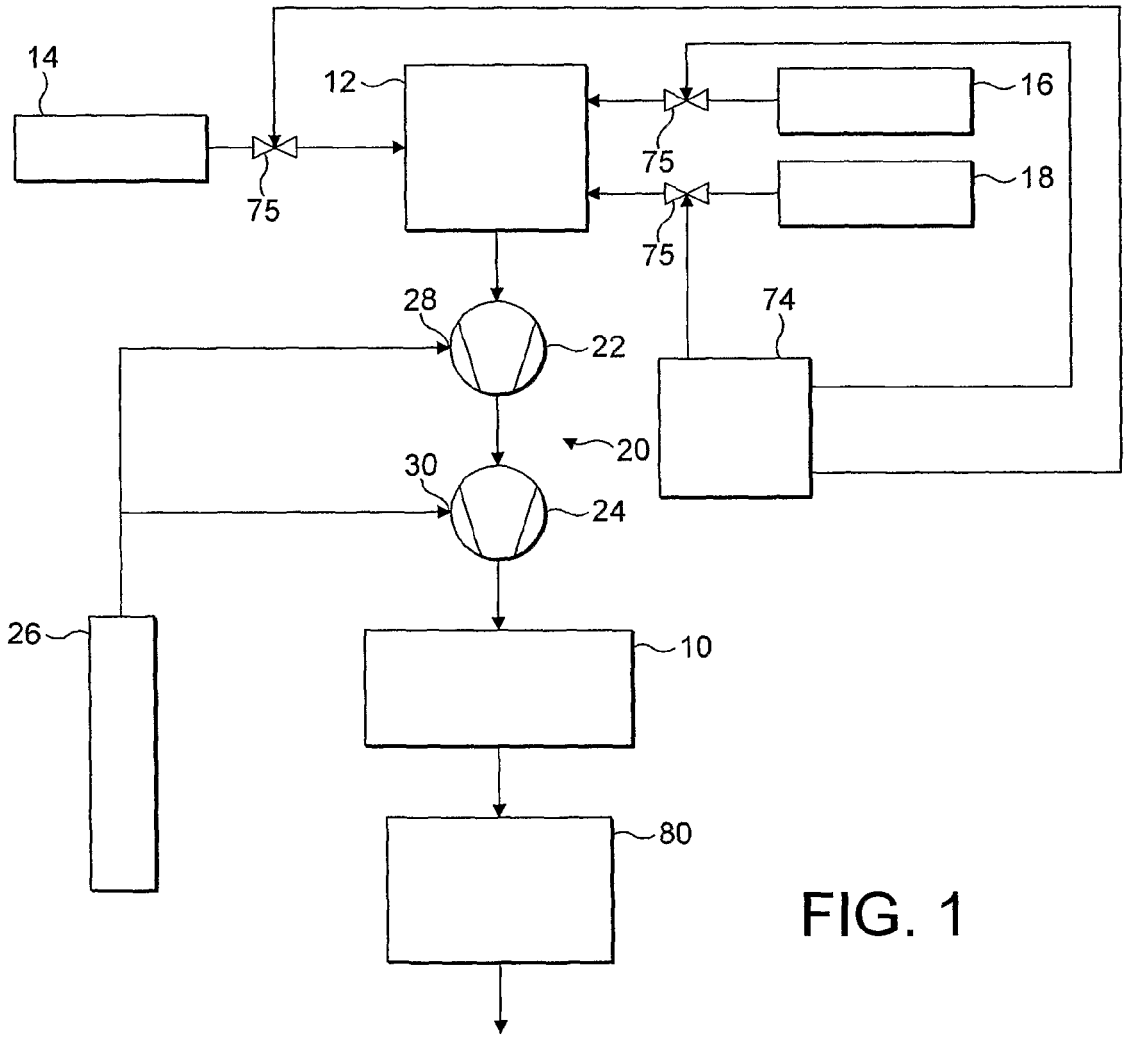
FIG. 1 illustrates a process chamber connected to a combustion apparatus according to one embodiment of the invention.

With reference first to FIG. 1, combustion apparatus 10 is provided for treating gases exhausting from a process chamber 12 for processing, for example, semiconductor devices, flat panel display devices or solar panel devices. The chamber 12 receives various process gases for use in performing the processing within the chamber. In this example, MOCVD (metal organic chemical vapour deposition) of a layer of material such as GaN is performed within the process chamber 12. Gases comprising organometallic sources of the group III metals Ga, In and/or Al, such as trimethyl gallium (TMG), trimethyl indium (TMI) and trimethyl aluminium (TMA), ammonia and hydrogen are conveyed to the process chamber 12 from respective sources 14, 16, 18 thereof at elevated temperatures to form thin films of material on wafers of a suitable substrate material (such as Si, SiC, sapphire or AlN).

An exhaust gas is drawn from the outlet of the process chamber 12 by a pumping system 20. During the processing within the chamber, only a portion of the process gases will be consumed, and so the exhaust gas will contain a mixture of the process gases supplied to the chamber, and by-products from the processing within the chamber. As illustrated in FIG. 1, the pumping system 20 may comprise a secondary pump 22, typically in the form of a turbomolecular pump, for drawing the exhaust gas from the process chamber. The turbomolecular pump 22 can generate a vacuum of at least $10^{-3}$ mbar in the process chamber 12. The gas is typically exhausted from the turbomolecular pump 22 at a pressure of around 1 mbar. In view of this, the pumping system also comprises a primary, or backing pump 24 for receiving the gas exhaust from the turbomolecular pump 22 and raising the pressure of the gas to a pressure around atmospheric pressure. In order to prevent damage to the pumping system 20 during pumping of the gases from the process chamber 12, a nitrogen purge gas is supplied from a source 26 thereof to one or more purge ports 28, 30 of the pumping system 20.

Figure 2:
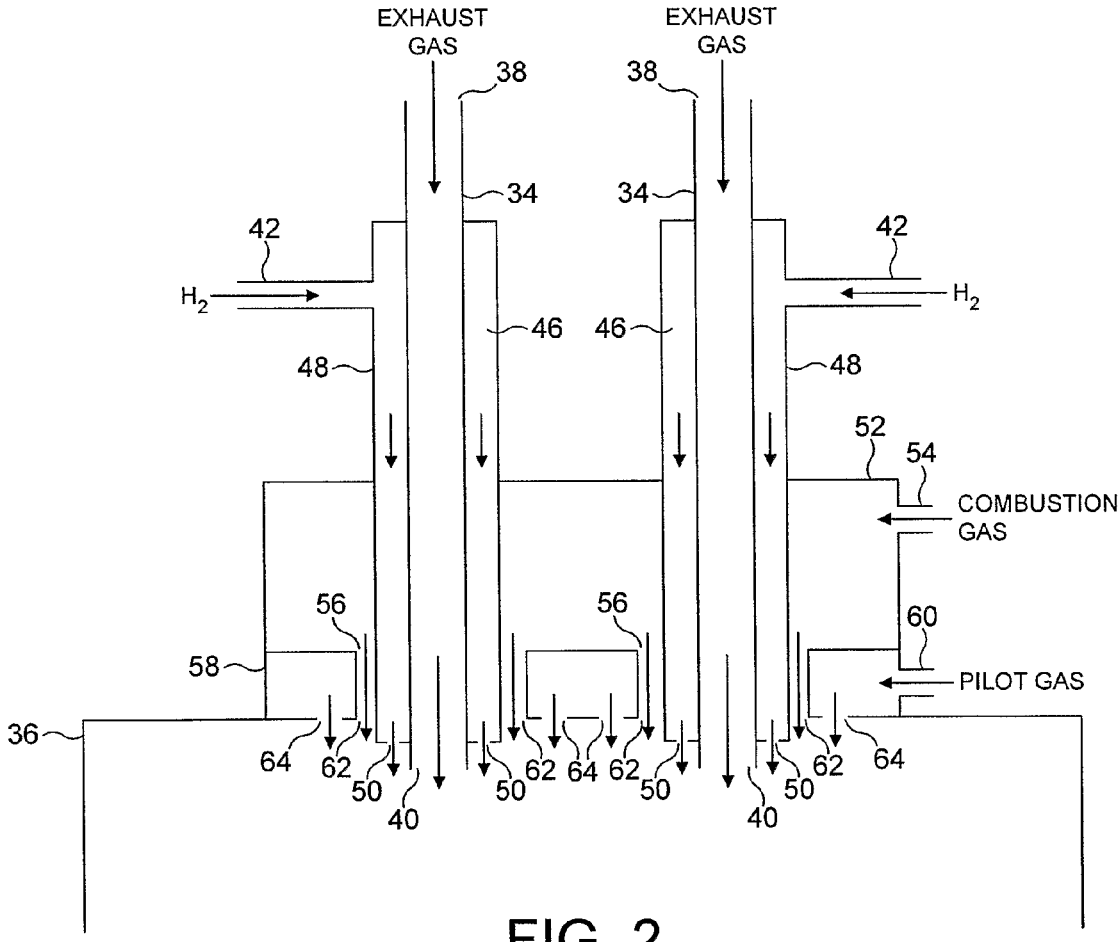
FIG. 2 illustrates a cross-sectional view of a plurality of exhaust gas combustion nozzles connected to a combustion chamber of the combustion apparatus of FIG. 1.

The gas exhaust from the pumping system 22 is conveyed to an inlet 32 of the combustion apparatus 10. As illustrated in FIG. 2, the inlet 32 comprises at least one exhaust gas combustion nozzle 34 connected to a combustion chamber 36 of the combustion apparatus 10. Each combustion nozzle 34 has an inlet 38 for receiving the exhaust gas, and an outlet 40 from which the exhaust gas enters the combustion chamber 38. Whilst FIG. 2 illustrates two combustion nozzles 34 for receiving the exhaust gas, the inlet 32 may comprise any suitable number, for example four, six or more, combustion nozzles 34 for receiving the exhaust gas. In the preferred embodiments, the inlet 32 comprises four combustion nozzles 34.

Figure 3:
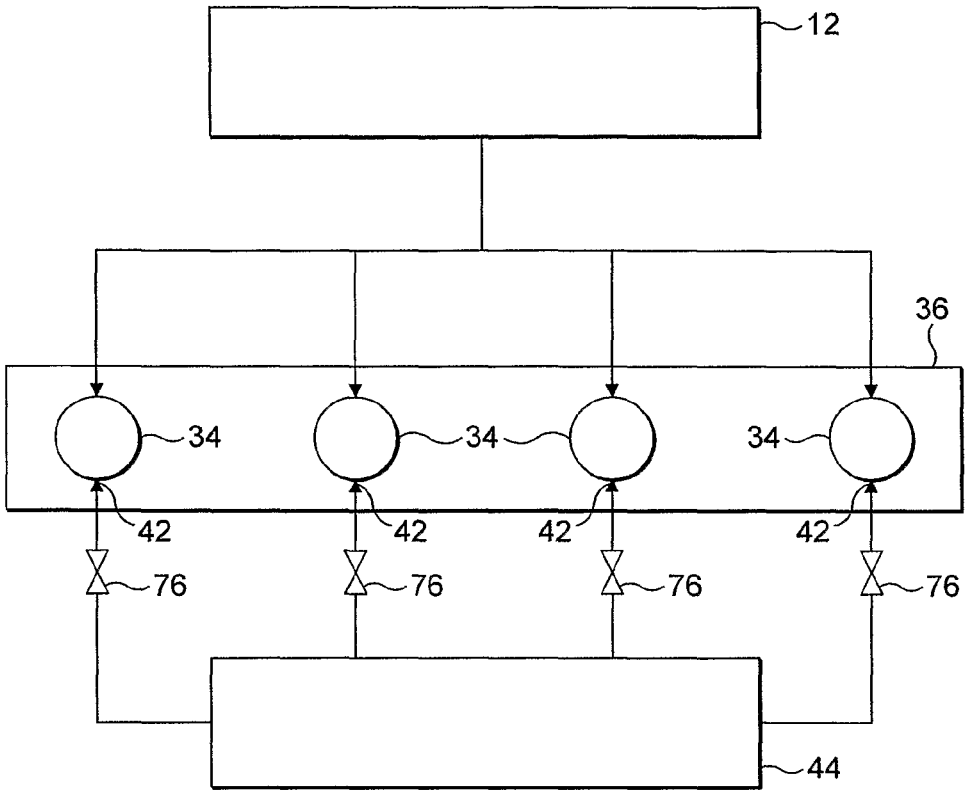
FIG. 3 illustrates an arrangement for supplying hydrogen to each combustion nozzle connected to the combustion chamber of FIG. 2.

In this embodiment of the invention, each combustion nozzle 34 includes a hydrogen inlet 42 for receiving hydrogen from a source 44 thereof (illustrated in FIG. 3). An annular gap 46 defined between the outer surface of the nozzle 34 and the inner surface of a sleeve 48 extending about the nozzle 34 allows the hydrogen to be conveyed from the inlet 42 to a plurality of hydrogen outlets 50 surrounding the nozzle 34 and from which the hydrogen enters the combustion chamber 36 co-axially with the exhaust gas.

As illustrated in FIG. 2, each combustion nozzle 34 is mounted in a first annular plenum chamber 52 having an inlet 54 for receiving a first gas mixture of fuel and oxidant, for example, a mixture of methane and air, providing a combustion gas for forming combustion flames within the combustion chamber 36, and a plurality of outlets 56 from which the combustion gas is conveyed into the combustion chamber 36. As illustrated in FIG. 2, the combustion nozzles 34 are mounted in the first plenum chamber 52 such that each nozzle 34 passes substantially co-axially through a respective outlet 56, such that the combustion gas is conveyed into the combustion chamber 36 about the sleeves 48 of the combustion nozzles 34.

As also illustrated in FIG. 2, the first plenum chamber 52 is located above a second annular plenum chamber 58 having an inlet 60 for receiving a second, pilot gas mixture of fuel and oxidant, for example, another mixture of methane and air, for forming pilot flames within the combustion chamber 36. As illustrated in FIG. 2, the second plenum chamber 58 comprises a plurality of first apertures 62 co-axial with the outlets 56 from the first plenum chamber 52 and through which the combustion nozzles 34 extend into the combustion chamber 36, and a plurality of second apertures 64 surrounding the first apertures 62. The second apertures 64 allow the pilot gas mixture to enter the combustion chamber 36 to form the pilot flame for igniting the combustion gas to form combustion flames within the combustion chamber 36. In the event that the abatement device is operated in pilot only then the supply of combustion gas to the first plenum chamber 52 may be discontinued. The pilot flame formed at the apertures 64 is then used to ignite the exhaust gas and any additional hydrogen supplied to the nozzles 34.

Figure 4:
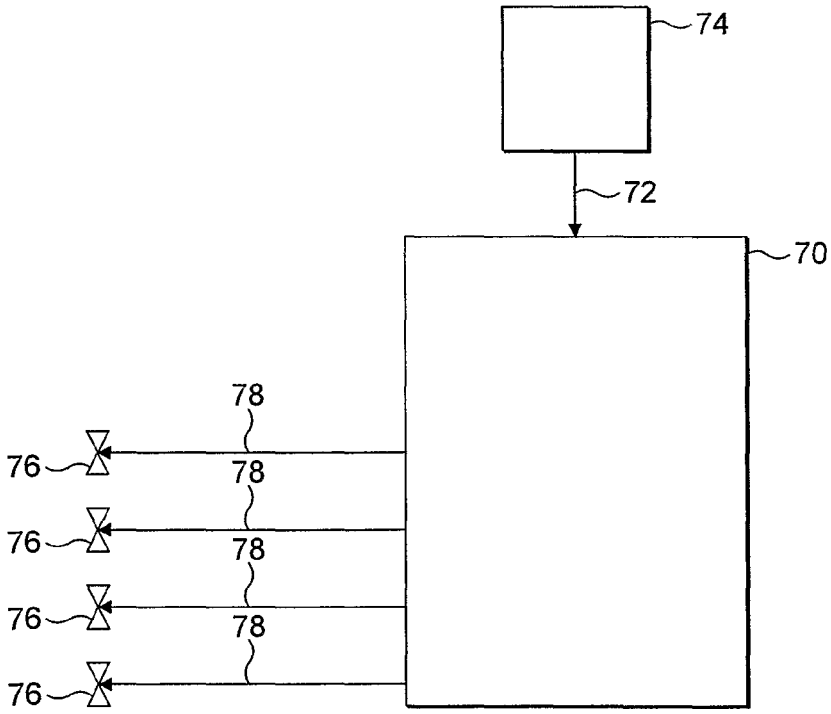
FIG. 4 illustrates a control system for controlling the amount of hydrogen supplied to each combustion nozzle of FIG. 2.

FIG. 4 illustrates a control system for controlling the supply of hydrogen to each of the combustion nozzles 34. The control system comprises a controller 70 for receiving signals 72 data indicative of a variation of the chemistry of the exhaust gas output from the process chamber 12 and thus supplied to the combustion nozzles 34. Each of the signals 72 may be received directly from a process tool 74 controlling the supply of gases to the process chamber 12 using valves 75, as illustrated in FIG. 1. Alternatively, the signals 72 may be received from a host computer of a local area network of which the controller 70 and the controller of the process tool 74 form part, the host computer being configured to receive information from the controller of the process tool regarding the chemistry of the gases supplied to the process chamber and to output the signals 72 to the controller 70 in response thereto. As another alternative, the signals 72 may be received from a gas sensor located between the outlet of the process chamber 12 and the combustion nozzles 34.

In response to the data contained in the received signals 72, the controller 70 may selectively control the supply of hydrogen to each combustion nozzle 34. With reference to FIGS. 3 and 4, the control system includes a plurality of variable flow control devices 76, for example valves 76 each located between the hydrogen source 44 and a respective hydrogen inlet 42, and moveable between open and closed positions in response to a signal 78 received from the controller 70. A chocked flow orifice may be provided between each valve 76 and the respective hydrogen inlet 42 for restricting the rate of supply of hydrogen to each hydrogen inlet 42. Alternatively, a single valve 76 may be used to control the supply of hydrogen to each of the combustion nozzles 34 providing the inlet 32 of the combustion apparatus 10.

When the valves 76 are open, hydrogen is conveyed from the hydrogen source 44 to each hydrogen inlet 42. The hydrogen passes downwards (as illustrated) within the annular gap 46, and is output from the hydrogen outlets 50 into the combustion chamber 36 for combustion with the exhaust gas.

By selectively adding hydrogen to the gas combusted within the combustion chamber 36, the controller 70 can maintain the relative amounts of ammonia and hydrogen combusted within the combustion chamber 36 at or around predetermined values, for example at least 1:1, thereby maintaining a high DRE of ammonia. We have found experimentally that mixtures of hydrogen, ammonia and nitrogen in approximate ratios of 1:1:1 and 2:1:1 respectively can be combusted below the TLV of ammonia using only a pilot flame of the combustion chamber, and it is anticipated that combustion of mixtures with lower amounts of hydrogen will be similarly achievable. As there is thus no longer any requirement to provide combustion gas to the combustion chamber 36 for the combustion of ammonia at least, fuel consumption may be significantly reduced.

Returning to FIG. 1, the by-products from the combustion of the exhaust gas within the combustion chamber 36 may be conveyed to a wet scrubber, solid reaction media, or other secondary abatement device 80, as illustrated in FIG. 1. After passing through the abatement device 80, the exhaust gas may be safely vented to the atmosphere.

Figure 5:
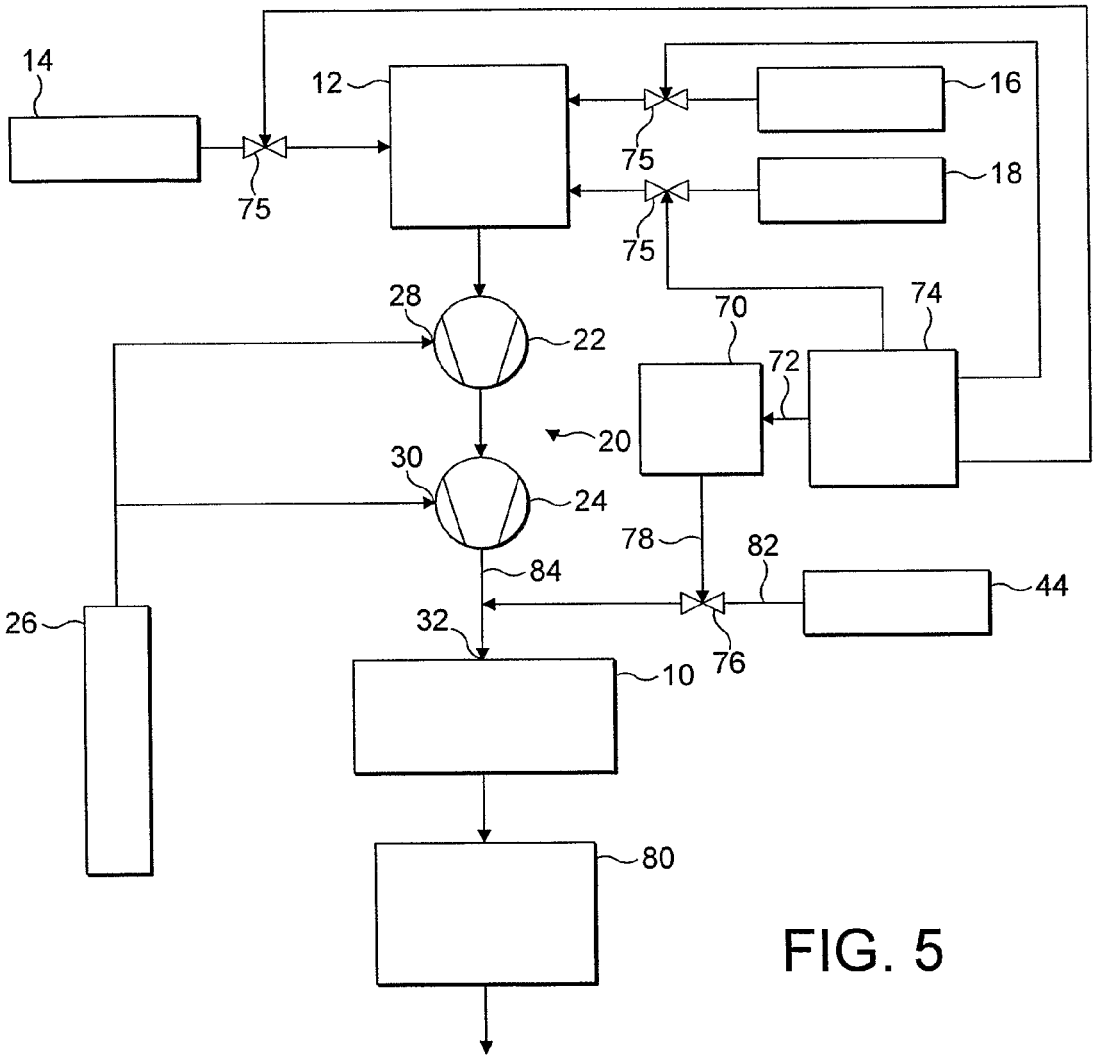
FIG. 5 illustrates a process chamber connected to a combustion apparatus according to another embodiment of the invention.

FIG. 5 illustrates a second embodiment, in which the additional hydrogen is conveyed to the exhaust gas upstream from the inlet 32 of the combustion apparatus 10. In this embodiment, a first conduit system 82 conveys the hydrogen from the hydrogen source 44 to a second conduit system 84 for conveying the exhaust gas from the pumping system 20 to the inlet 32 of the combustion apparatus 10. As illustrated, a single valve 76 may be provided in the first conduit system 82 and controlled by the controller 70 in response to signals 72 received from the controller of the process tool 74 to selectively convey hydrogen from the hydrogen source 74 to the exhaust gas within the second conduit system 84. A chocked flow orifice may be provided between the valve 76 and the second conduit system 84 for restricting the rate of supply of hydrogen to exhaust gas. In this embodiment, therefore, the hydrogen inlet 42 and sleeve 48 of each combustion nozzle 34 may be omitted.

We have found that the destruction and removal efficiency (DRE) of ammonia is significantly enhanced when a predetermined amount of hydrogen is present in the gases to be combusted by the flame. By selectively adding hydrogen to the exhaust gas when the exhaust gas contains ammonia but not a sufficient amount of hydrogen to achieve a high DRE of ammonia, the DRE of ammonia can be maintained at a consistently high level.

In one preferred embodiment the hydrogen is conveyed to the nozzle for addition to the exhaust gas, where the hydrogen is preferably injected into the combustion chamber from a plurality of apertures extending about the combustion nozzle. In another preferred embodiment, the hydrogen is added to the exhaust gas upstream from the combustion nozzle, thereby promoting mixing of the additional hydrogen with the exhaust gas.

The addition of hydrogen to the exhaust gas may be timed according to the cycle of gas supply to the chamber. Alternatively, the amount of hydrogen added to the exhaust gas may be adjusted in response to the reception of data indicative of a variation of the chemistry of the gas exhaust from the chamber. The data indicative of the variation of the chemistry of the exhaust gas being supplied by the process tool, for example when the gases supplied to the chamber do not contain sufficient hydrogen to achieve a high ammonia DRE. Alternatively, a gas sensor may be located within a conduit system for conveying the exhaust gas to the nozzle, with this sensor being configured to supply the data.

Hydrogen is preferably added to the exhaust gas so that the ratio by volume of hydrogen to ammonia combusted by the flame is at least 1:1. We have found that mixtures of hydrogen, ammonia and nitrogen in approximate ratios of 1:1:1 and 2:1:1 respectively can be combusted below the TLV of ammonia using only a pilot flame of the combustion chamber. The pilot flame is typically formed from a mixture of fuel and oxidant, for example methane and air, in a ratio by volume of between 1:8 and 1:12. Consequently, the amount of methane or other fuel supplied to the chamber to form the combustion flame can be significantly reduced, thereby reducing operating costs.

While the foregoing description and drawings represent the preferred embodiments of the present invention, it will be apparent to those skilled in the art that various changes and modifications may be made therein without departing from the true spirit and scope of the present invention.

We claim:

1. A method of combusting ammonia, the method comprising the steps of: conveying an exhaust gas containing varying amounts of ammonia and elemental hydrogen from a process chamber to a combustion nozzle connected to a combustion chamber, supplying to the combustion chamber a combustion gas for forming a combustion flame within the combustion chamber, and selectively adding hydrogen to the exhaust gas at a location upstream from the combustion chamber depending on the relative amounts of ammonia and hydrogen exhaust from the process chamber, thereby ensuring a predetermined amount of hydrogen present in the exhaust gas to be mixed with the combustion gas when forming the combustion flame within the combustion chamber, wherein the step of selectively adding hydrogen to the exhaust gas comprises adjusting the amount of hydrogen added in response to the reception of data indicative of a variation of the chemistry of the gas exhaust from the chamber.

2. The method according to claim 1 wherein the step of selectively adding hydrogen to the exhaust gas comprises conveying hydrogen to the nozzle for addition to the exhaust gas.

3. The method according to claim 1 wherein the step of selectively adding hydrogen to the exhaust gas comprises injecting hydrogen into the combustion chamber from a plurality of apertures extending about the combustion nozzle.

4. The method according to claim 1 wherein the chamber is associated with a process tool and the data is supplied by the process tool.

5. The method according to claim 1 wherein step of selectively adding hydrogen to the exhaust gas comprises adding the hydrogen so that the ratio by volume of hydrogen to ammonia combusted by the flame is at least 1:1.

6. The method according to claim 1 wherein the combustion gas comprises a mixture of a fuel and an oxidant.

7. The method according to claim 6 wherein the fuel comprises methane.

8. The method according to claim 6 wherein the oxidant comprises air.

9. The method according to claim 6 wherein the ratio by volume of fuel and oxidant within the combustion gas is between 1:8 and 1:12.

10. The method according to claim 1 wherein the step of supplying to the chamber the combustion gas comprises supplying the combustion gas to the chamber substantially coaxially with the exhaust gas.

11. The method according to claim 1 wherein the exhaust gas comprises at least one of ammonia, hydrogen and nitrogen.

12. Apparatus for combusting exhaust gas, the apparatus comprising: a combustion chamber, means for supplying to the combustion chamber a combustion gas for forming a combustion flame within the combustion chamber, a combustion nozzle connected to the combustion chamber, means for conveying an exhaust gas containing varying amounts of ammonia and elemental hydrogen from a process chamber to the nozzle, and means for selectively adding hydrogen to the exhaust gas at a location upstream from the combustion chamber depending on the relative amounts of ammonia and hydrogen exhaust from the process chamber, thereby ensuring a predetermined amount of hydrogen present in the exhaust gas to be mixed with the combustion gas when forming the combustion flame within the combustion chamber, wherein the hydrogen adding means comprises means for receiving data indicative of a variation of the chemistry of the gas exhaust from the chamber, and for adjusting the amount of hydrogen added to the exhaust gas in response thereto.

13. The apparatus according to claim 12 wherein the hydrogen adding means is configured to convey the additional hydrogen to the combustion nozzle for addition to the exhaust gas.

14. The apparatus according to claim 13 wherein the hydrogen adding means comprises a sleeve extending about the nozzle for receiving the additional hydrogen and conveying the additional hydrogen to the combustion chamber.

15. The apparatus according claim 12 wherein the hydrogen adding means comprises a plurality of apertures extending about the combustion nozzle from which the additional hydrogen is injected into the combustion chamber.

16. The apparatus according to claim 12 wherein the hydrogen adding means is configured to add hydrogen to the exhaust gas upstream from the combustion chamber.

17. The apparatus according to claim 12 wherein the exhaust gas is exhaust from a chamber of a process tool, the data indicative of the variation of the chemistry of the exhaust gas being supplied by the process tool.

18. The apparatus according to claim 12 wherein the hydrogen adding means is configured to add hydrogen to the exhaust gas so that the ratio by volume of hydrogen to ammonia combusted by the flame is at least 1:1.

19. The apparatus according to claim 12 wherein the combustion gas comprises a mixture of a fuel and an oxidant.

20. The apparatus according to claim 19 wherein the fuel comprises methane.

21. The apparatus according to claim 19 wherein the oxidant comprises air.

22. The apparatus according to claim 19 wherein the ratio by volume of fuel and oxidant within the combustion gas is between 1:8 and 1:12.

23. The apparatus according to claim 12 wherein the combustion gas supply means is configured to supply the combustion gas to the chamber substantially co-axially with the exhaust gas.

* * * * *